US008745791B1

(12) United States Patent
Ullrich et al.

(10) Patent No.: US 8,745,791 B1
(45) Date of Patent: Jun. 10, 2014

(54) PATIENT LIFTER

(75) Inventors: Osmar A. Ullrich, Hilliard, OH (US); Steven A. Sauer, Columbus, OH (US)

(73) Assignee: Osmar A. Ullrich, Hilliard, OH (US)

( * ) Notice: Subject to any disclaimer, the term of this patent is extended or adjusted under 35 U.S.C. 154(b) by 1238 days.

(21) Appl. No.: 12/485,367

(22) Filed: Jun. 16, 2009

(51) Int. Cl.
*A61G 1/017* (2006.01)

(52) U.S. Cl.
USPC ..... 5/626; 5/625; 5/627; 5/628; 5/629; 5/630

(58) Field of Classification Search
USPC ..... 5/625–630
See application file for complete search history.

(56) References Cited

U.S. PATENT DOCUMENTS

| | | | | | |
|---|---|---|---|---|---|
| 280,004 | A | * | 6/1883 | Bakewell | 297/18 |
| 352,067 | A | * | 11/1886 | Phillips | 297/68 |
| 662,557 | A | * | 11/1900 | Cole | 297/27 |
| 1,975,689 | A | * | 10/1934 | Hall | 297/18 |
| 2,362,721 | A | * | 11/1944 | Reynolds | 5/626 |
| 2,407,786 | A | * | 9/1946 | Keest | 297/1 |
| 2,520,094 | A | * | 8/1950 | Hand | 297/19 |
| 2,699,557 | A | * | 1/1955 | Gravatt | 5/626 |
| 2,793,868 | A | | 5/1957 | Fuglie et al. | |
| 2,823,921 | A | | 2/1958 | Lagaard | |
| 2,858,879 | A | * | 11/1958 | Branson | 297/19 |
| 3,122,758 | A | * | 3/1964 | Ferneau | 5/626 |
| 3,896,904 | A | | 7/1975 | Walker | |
| 3,930,662 | A | | 1/1976 | Manner | |
| 4,033,595 | A | | 7/1977 | Mauch | |
| 4,524,484 | A | * | 6/1985 | Graham | 16/429 |
| 5,233,708 | A | * | 8/1993 | Winston, Sr. | 5/81.1 R |
| 5,502,851 | A | | 4/1996 | Costello | |
| 5,572,756 | A | * | 11/1996 | Muuranen et al. | 5/626 |
| 5,586,352 | A | * | 12/1996 | O'Brien et al. | 5/662 |
| 5,649,780 | A | * | 7/1997 | Schall | 403/109.4 |
| 5,674,002 | A | | 10/1997 | Powell et al. | |
| 5,819,340 | A | * | 10/1998 | Kelly | 5/95 |
| 5,829,766 | A | * | 11/1998 | Gohlert | 280/47.34 |
| 5,860,754 | A | * | 1/1999 | Garland et al. | 401/6 |
| 5,983,455 | A | * | 11/1999 | Polzin et al. | 16/429 |
| 6,012,182 | A | * | 1/2000 | Allen et al. | 5/81.1 R |
| 6,086,085 | A | * | 7/2000 | Larsson | 280/648 |
| 6,302,375 | B1 | | 10/2001 | Heil et al. | |

(Continued)

OTHER PUBLICATIONS http://www.shoplet.com/office/db/STB390006BLK.html; Bond. Three-Way Luggage; Feb. 2, 2009.

*Primary Examiner* — Robert G Santos
*Assistant Examiner* — Ifeolu Adeboyejo
(74) *Attorney, Agent, or Firm* — William B. Richards, Esq.; The Richards Law Firm LLC

(57) ABSTRACT

A patient lifter is provided which includes a pair of side members with a patient support extending therebetween. Arcuate front supports extend from a first end of each side member and the inside bend of each arcuate front support generally faces the patient support. A handle at a second end of the side members facilitates a lift. As the lift begins, a first mechanical advantage is effected by the patient being relatively close to a fulcrum of the lifter. Large vertical travel by the lifting force results in relatively little vertical travel by the patient. As the lift progresses, and the one doing the lift is in a better position to exert additional lifting force, the fulcrum shifts to provide a second, lower, mechanical advantage, but the patient moves further in the vertical direction relative to the vertical travel of the handle.

22 Claims, 8 Drawing Sheets

(56) References Cited

U.S. PATENT DOCUMENTS

| | | | | |
|---|---|---|---|---|
| 6,311,942 | B1 * | 11/2001 | Rotter et al. | 248/316.5 |
| 6,425,590 | B1 * | 7/2002 | Whiteside et al. | 280/32.6 |
| 6,430,761 | B1 | 8/2002 | Brandorff et al. | |
| 6,648,343 | B2 * | 11/2003 | Way et al. | 280/5.22 |
| 6,722,076 | B2 * | 4/2004 | Nielsen | 42/146 |
| 6,752,380 | B1 | 6/2004 | Taylor et al. | |
| 6,851,685 | B2 | 2/2005 | Koenig | |
| 7,185,879 | B1 | 3/2007 | Lejuez | |
| 2005/0279520 | A1 * | 12/2005 | Newman et al. | 174/48 |
| 2006/0185079 | A1 * | 8/2006 | Walkingshaw | 5/86.1 |
| 2006/0218752 | A1 * | 10/2006 | Potempa | 16/429 |
| 2006/0230540 | A1 * | 10/2006 | Whelan | 5/662 |
| 2007/0061971 | A1 * | 3/2007 | DeBraal et al. | 5/617 |
| 2008/0295254 | A1 | 12/2008 | Meekins | |

* cited by examiner

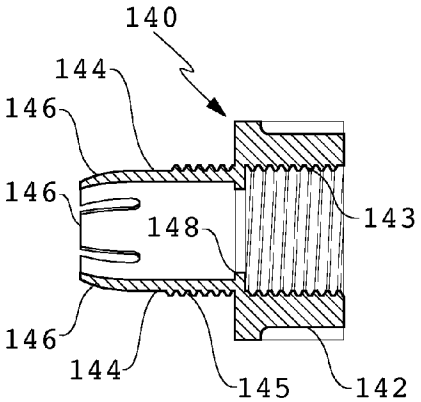
FIG-11
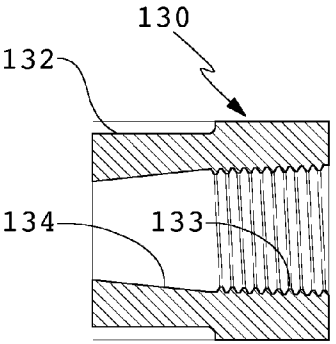
FIG-10
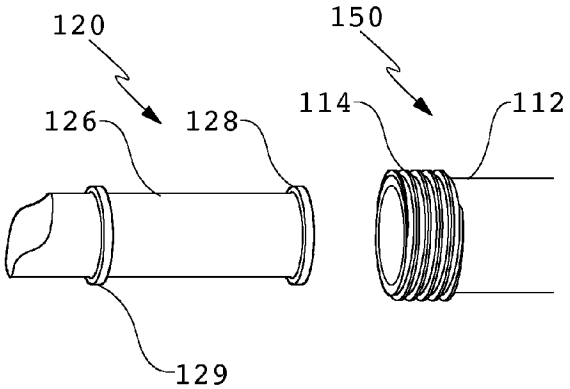
FIG-9
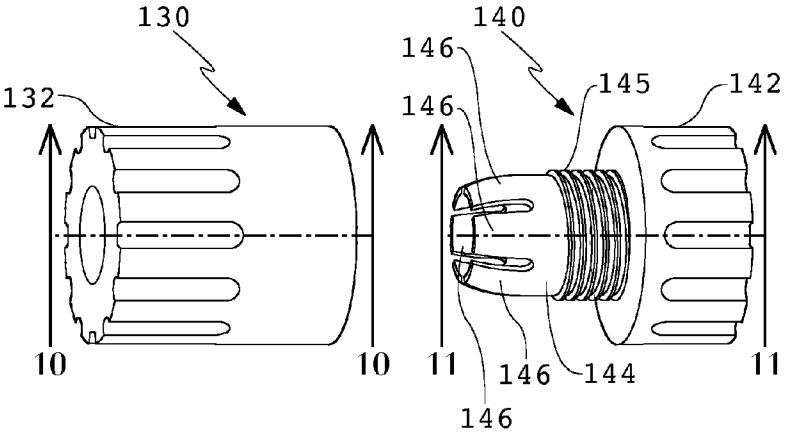

PATIENT LIFTER

TECHNICAL FIELD

This description relates to patient lifter apparatus, particularly to apparatus for lifting a patient from the floor or the ground to a chair or a bed.

BACKGROUND

There are times when a patient, especially a patient who is not particularly ambulatory, must be lifted from the floor or the ground to a chair or bed. This process may be further complicated when the patient is heavy and/or the one lifting is lacking in physical strength. In operation, at least a portion of the lifter must be lowered to the floor and placed underneath the patient. For example, a sling is placed around and/or under the patient who is on the floor. Alternatively, a platform or seat is placed on the floor and the patient slid or otherwise moved onto it. Subsequently, the patient is lifted via a motorized frame or other device or manually lifted using the strength of the person doing the lift. In a non-motorized device, an articulated arm or frame may be utilized. Such patient lifters are described in U.S. Pat. Nos. 5,502,851 and 6,430,761. Adequate lifters can, however, be heavy, cumbersome, and lack portability.

SUMMARY

The need for one to lift an object or person, for example, a patient, from the floor to a raised level such as a bed or chair, can present significant challenges, especially to one who may be somewhat lacking in physical strength faced with lifting a heavier patient. Such a task may be facilitated by utilizing a mechanical lifter which provides a second class lever having a variable mechanical advantage. A lifter providing a high mechanical advantage at the start of the lift, when the kneeling or bent over position of one lifting may inhibit the use of much force by the individual, can make the initial part of the lift easier. Then, as one begins to stand and becomes better positioned to use lifting force, however, the lifter providing less of a mechanical advantage, but greater lifting distance for the travel of the force, can make the final part of the lift more efficient.

In an embodiment, the lifter has two parallel side members and a patient support, or seat secured therebetween. The seat is so attached that it can rotate about a horizontal axis during use. Attached to one end of each of the side members is a curved, or arcuate, front support. Each front support bends back toward the patient support. At the other ends of the side members, an extendible handle may be telescopically connected to the side members. Extension locks secure the handle to the side members.

In a further embodiment the extension lock comprise a finger lock and a compression cap. The finger lock includes a passageway, a knob portion with internal first-handed threads which cooperate with like-handed threads on an end of the side member, and a male taper which includes external opposite-handed threads and a plurality of flexible fingers. The compression cap includes a passageway, opposite-handed internal threads which cooperate with the male taper external threads, and a female taper adapted to cooperate with the plurality of fingers.

In a further embodiment, the lifter collapses easily into a compact shape which can be easily stored beneath a bed, for example, hung on a wall, or stored in a small space, for example, between a refrigerator and a cabinet. By utilizing lightweight materials of construction, the lifter is easily handled and maneuvered and easily transported from one place to another.

Additional objects, features, and advantages of the invention will become apparent to those skilled in the relevant art upon consideration of the following detailed description of preferred embodiments exemplifying the best mode of carrying out the invention as presently perceived.

BRIEF DESCRIPTION OF THE SEVERAL VIEWS OF THE DRAWING

The accompanying drawings, which are incorporated in, and constitute a part of, this specification, illustrate several embodiments consistent with the invention and, together with the description, serve to explain the principles of the invention.

FIG. 9 is an exploded perspective view illustrating an extension lock.

FIG. 10 is a cross-sectional view taken along the line 10-10 of FIG. 9 showing internal threads and a female taper.

FIG. 11 is a cross-sectional view taken along the line 11-11 of FIG. 9 showing internal threads, a stop, and a male taper.

DETAILED DESCRIPTION

Figure 1:
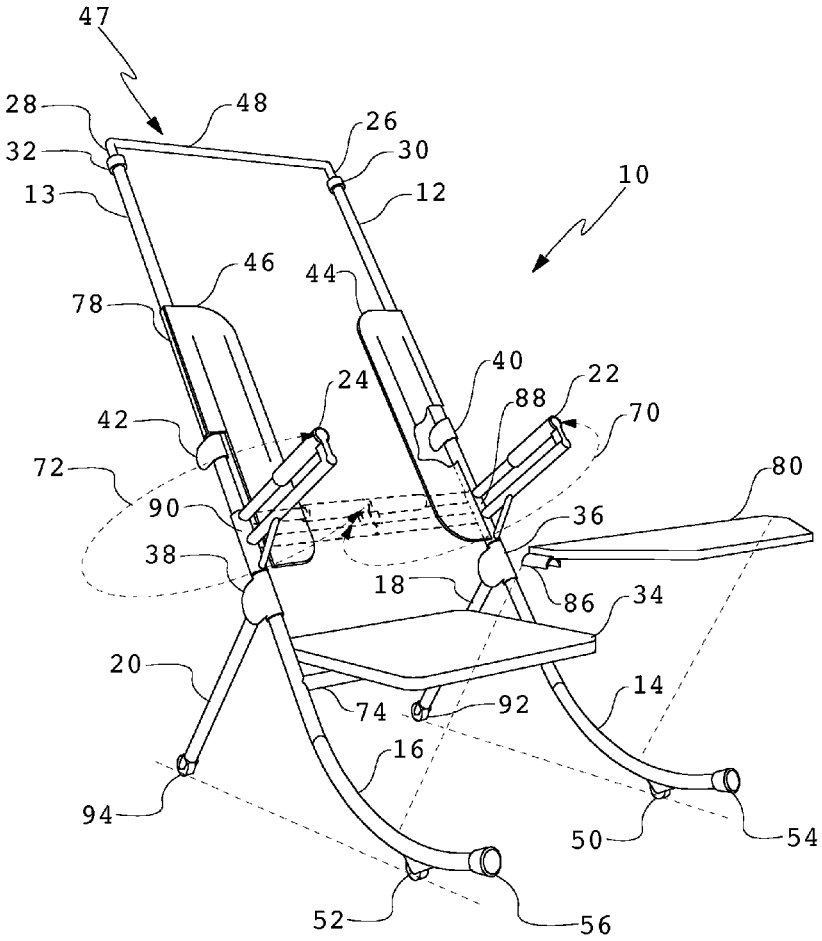
FIG. 1 is a perspective view illustrating a patient lifter.

Referring first to FIG. 1, a patient lifter 10 includes first and second side members 12, 13 in spaced, parallel relation, a patient support 34 extending between the first and second side members 12, 13, first and second spaced arcuate front supports 14, 16 extending from each of the side members 12, 13, respectively, and a handle 47. The side members 12, 13 may be constructed of metal, plastic, wood, or other suitable material. While the side members 12, 13 may be solid, in one embodiment, they are at least partially hollow. The side members 12, 13 may be tubular and may have a circular or square cross section. Light weight metals, such as aluminum, for example, are well-suited for the materials of construction of the side members 12, 13.

Figure 2:
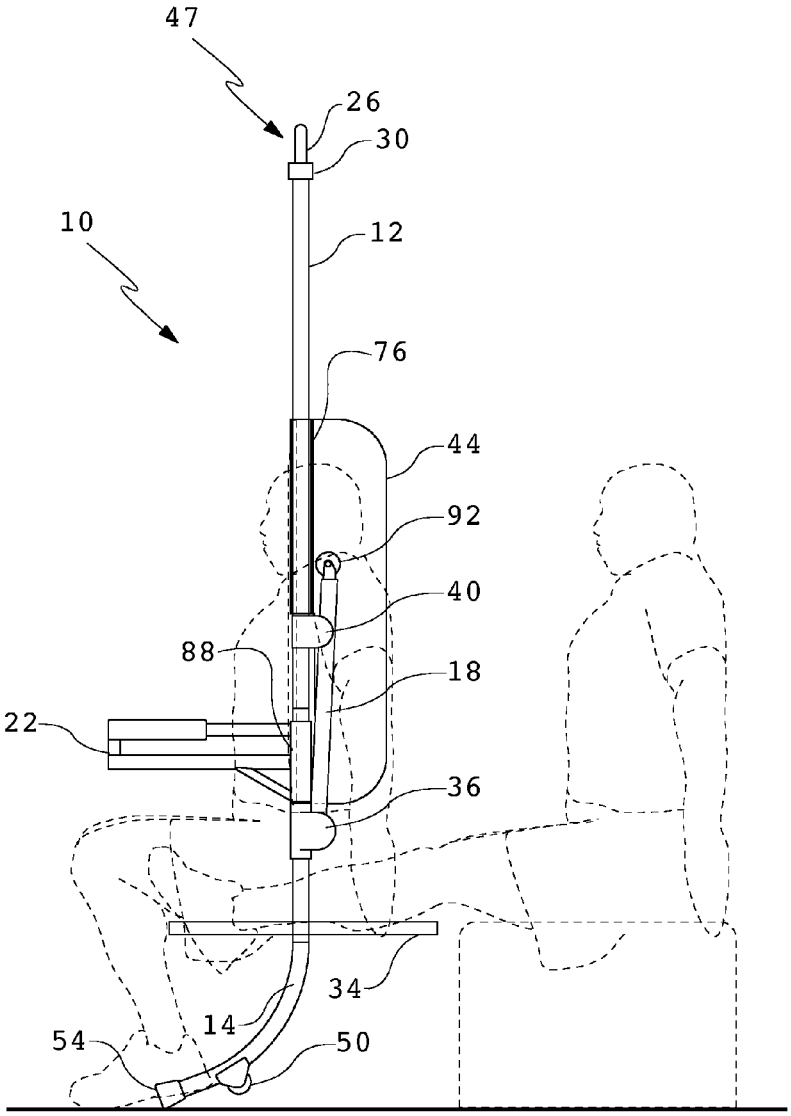
FIG. 2 is a side elevation view illustrating the patient lifter of FIG. 1 in a vertical position showing the patient transporting from the lifter to a bed or chair.

The patient support 34 comprises a surface upon which the patient may be seated while being lifted or while being transported. In one embodiment, a support cross member 74 extends between the first and second side members 12, 13. In a further embodiment, the patient support 34 comprises extensions (not shown) which are operably attached to the side members 12, 13. As shown in FIGS. 1 and 2, the patient support 34 is closer to the front arcuate supports 14, 16 than to the handle 47. The patient support 34 is allowed to rotate relative to the side members 12, 13 to facilitate keeping the patient upright during a lift. In one embodiment, the support cross member 74 is affixed to the side members 12, 13 and the patient support 34 is rotatably attached to, and rotates about, the support cross member 74. In a further embodiment, the patient support 34 is affixed to the cross member 34 and the cross member 34 is allowed to rotate relative to the side members 12, 13. As will be appreciated by those skilled in the relevant art, other methods of adapting the patient support 34 to at least partially rotate relative to an axis substantially perpendicular to the side members 12, 13 may be employed.

Extending from the side members 12, 13 are the arcuate front supports 14, 16. As shown in FIGS. 1 and 2, the inside bend of each arcuate front support 14, 16 generally faces the patient support 34. While FIGS. 1 and 2 show arcuate front supports 14, 16 having a continuous curve, it will be appreciated by those skilled in the relevant art that the arcuate front supports 14, 16 may also be piecewise linearly arcuate. The arcuate front supports 14, 16 may be permanently attached to the side members 12, 13 or may be removable, for example, to allow an exchange with other types of front supports such as straight front supports 58, 60 (FIGS. 3-6). In addition, the arcuate front supports 14, 16 may be rotatable on the side members 12, 13 so that they may be turned inward to point toward one another so as to lower the profile of the lifter 10 for convenience of storage. Alternatively, they may be turned outward to facilitate moving the patient onto the lifter, then when the patient is positioned on the lifter, the arcuate front supports 14, 16 may be rotated into the position shown in FIG. 1.

Figure 7:
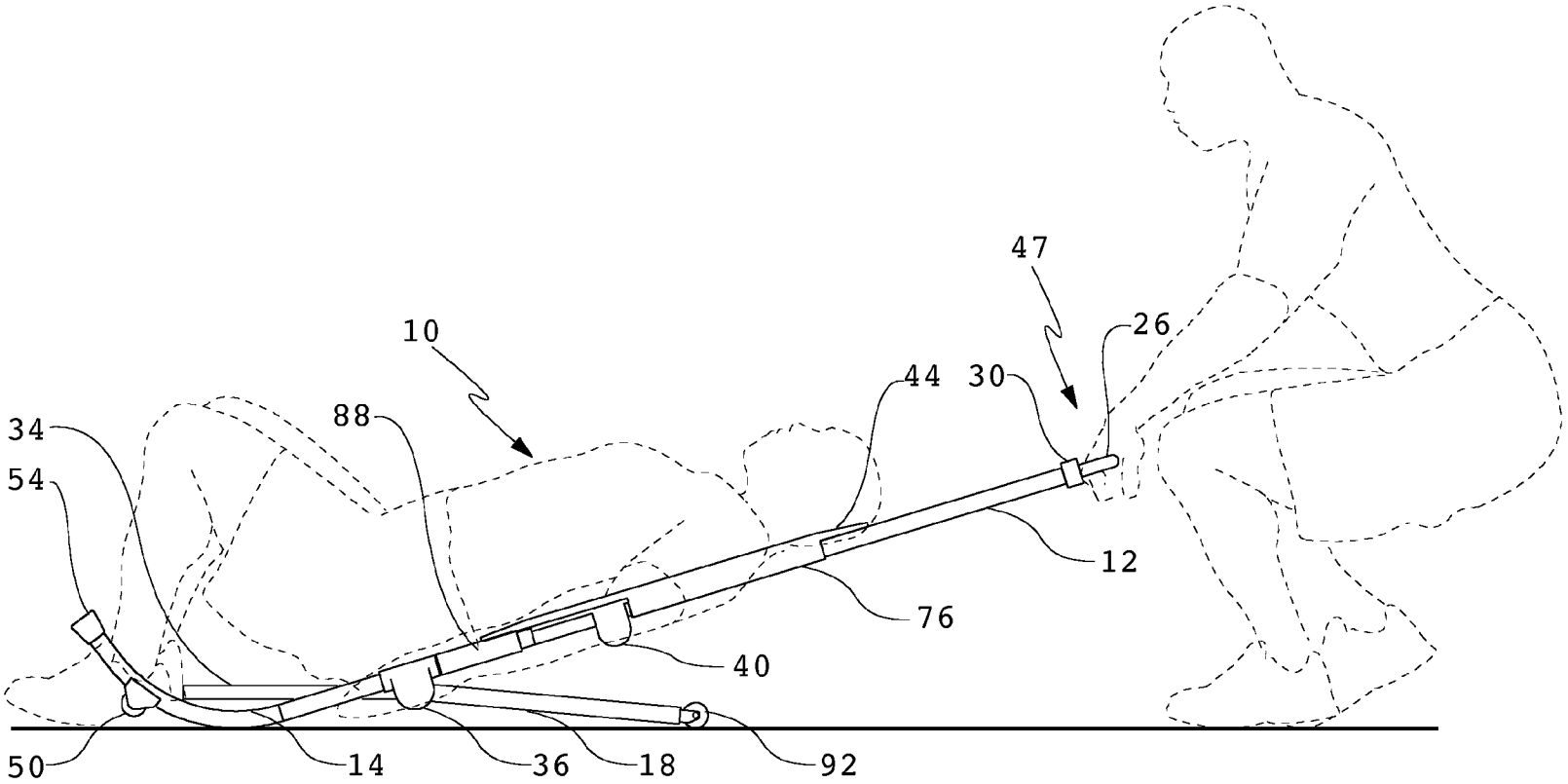
FIG. 7 is a side elevation view illustrating the patient lifter of FIG. 1 in an initial lift position.

As shown in FIGS. 1, 2, and 7, the arcuate front supports 14, 16 may further include wheels 50, 52 for ease of transporting a patient supported on the lifter 10. Such configuration may also cooperate with the rear supports 18, 20.

The handle 47 (best seen in FIG. 1) includes first and second extensions 26, 28 which extend from a handle cross member 48. The first and second extensions 26, 28 may be in slideable relation to the first and second side members 12, 13, respectively. In one embodiment, the first and second extensions 26, 28 telescope into the first and second side members 12, 13. As will be appreciated by those skilled in the art, the slideable relation between the first and second extensions 26, 28 and the first and second side members 12, 13, respectively, may be effected by, for example, external tracks and the like. Also included are first and second extension locks 30, 32 to secure the handle extensions 26, 28 relative to the side members 12, 13. Thus, the handle 47 may be easily and quickly extended for use and for additional leverage or collapsed within the side members 12, 13 as desired for storage. Locks to secure telescopic members such as the first and second handle extensions 26, 28 and the first and second side members 12, 13, may employ threaded twist-knobs or cams.

In a further embodiment, shown in FIGS. 9-11, an extension lock 130 is used to secure a handle extension 126 to a side member 112. As will be appreciated by those skilled in the relevant art, the extension lock 130 can replace the nominal first and second extension locks 30, 32. Further, the extension lock 130-handle extension 126-side member 112 combination can replace the extension locks 30, 32-handle extensions 26, 28-side members 12, 13 combinations shown, for example, in FIG. 1.

As shown in FIG. 9, the side member 112 includes, on an end opposite the arcuate front supports 13, 16 (or, as shown in FIGS. 3-6, the straight front supports 58, 60) external threads 114. In an embodiment, the external threads 114 are left-hand threads.

As also shown in FIG. 9, the handle extension 126 may include, on an end opposite the handle cross member 48, a handle extension lip 128. In addition, the handle extension 126 may further include a handle extension stop 129. The handle extension lip 128 is sized to fit slideably within the inside diameter of the side member 112.

Still looking at FIG. 9, and now, also, at FIG. 11, the extension lock 130 further includes a finger lock 140. The finger lock 140 is formed to include a finger lock knob 142 with internal threads 143. In an embodiment, the internal threads 143 are left-hand threads to mate with the external threads 114 included on the side member 112. The finger lock 140 is also formed to include a finger lock male taper 144 and the finger lock male taper 144 is formed to include external threads 145 and a plurality of flexible fingers 146. In an embodiment, the external threads 145 are opposite-handed the threads 114 and 143, in this case, right-handed. As shown most clearly in FIG. 11, the fingers 146 may cooperate to flexibly reduce the internal diameter of the male taper 144. The finger lock 140 is formed to include a passageway therethrough. The finger lock 140 is further formed to include a finger lock stop 148 which protrudes into the passageway and effectively reduces the internal diameter of the finger lock 140. The internal diameter of the finger lock 140 effected by the finger lock stop 148 may be less than the diameter of the handle extension stop 129.

Also shown in FIG. 9, the extension lock further includes a compression cap 132 which includes a compression cap female taper 134 and is formed to include internal threads 133 (FIG. 10). The internal threads 133 mate with the external threads 145. The compression cap 132 is formed to include a passageway therethrough.

As can be seen from FIG. 9, and with reference to FIGS. 10 and 11, as assembled, the handle extension 126 is inserted into the side member 112. The handle extension lip 128 may be sized to fit slideably, but snugly, within the inside diameter of the side member 112. By doing so, the handle extension lip 128 effects a support point within the side member 112 to, along with other support points, help secure the handle extension 126 from lateral movement.

The finger lock 140 is slid over the handle extension 126 and threaded onto the outside threads 114 of the side member 112. In doing so, the flexible fingers 146 accommodate the outside diameter of the handle extension 126. As will be appreciated by those skilled in the relevant art, the finger lock 140 may be secured to the side member 112 by clips or other means meant to prohibit both rotating and sliding motion of the finger lock 140 relative to the side member 112.

The compression cap 132 is slid over the handle extension 126 and threaded onto the outside threads 145 of the finger lock male taper 144. When the compression cap 132 is tightened, the female taper 134 urges the fingers 146 into contact with the handle extension 126, thus frictionally limiting its telescopic movement relative to the side member 112 and to the finger lock 140. The fingers 146 also provide a further support point, which may cooperate with the support point provided by the handle extension lip 128 to help secure the handle extension 126 from lateral movement.

In operation, when it is desired to extend or retract the handle extension 126, the compression cap 132 is at least partially unscrewed to enable the handle extension 126 to slide relative to the finger lock 140. By forming the thread set 133, 145 as one hand and the thread set 143, 114 as the other hand, unscrewing the compression cap 132 will not tend to loosen the finger lock 140 from the side member 112.

Helping keep the handle extension 126 from sliding completely out of the side member 112, the handle extension stop 129 meets the finger lock stop 148 and the handle extension 126 can extend no further. The handle extension stop 129 may be placed appropriately to minimize excessive bending force on the handle extension 126.

When the lifter 10 is in a flat horizontal position with the patient supported thereon, one may lift up on the handle 47 thereby lifting the patient. The arcuate front supports 14, 16 form a variable fulcrum of a second class lever system. The arcuate front supports 14, 16 are at one end of the lifter 10, the patient represents the weight to be moved and is nearer the fulcrum, and the lifting force is at the other end of the lifter 10 at the handle 47. As shown in FIG. 7, at the initiation of a lift, a first mechanical advantage is effected by the patient being relatively close to the fulcrum. Large vertical travel by the lifting force results in relatively little vertical travel by the patient. As the lift progresses, and the one lifting is in a better position to exert additional lifting force, the fulcrum shifts to provide a further, lower, mechanical advantage, but the patient moves farther in the vertical direction relative to the vertical travel of the handle 47.

Figure 4:
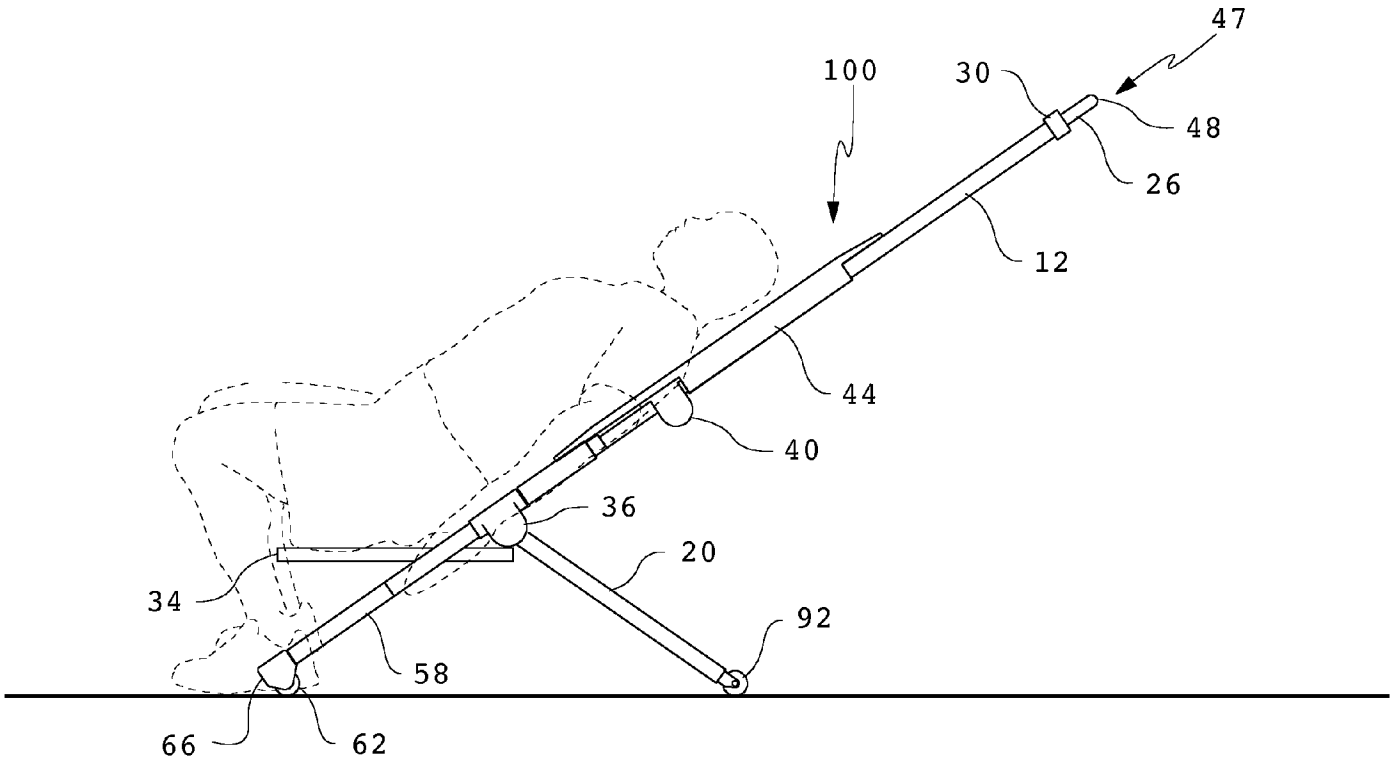
FIG. 4 is a side elevation view illustrating the patient lifter of FIG. 3 in a partially raised position.

The lifter 10 may also include first and second rear supports 18, 20 and the rear supports 18, 20 may further include wheels 92, 94 for ease of transporting a patient supported on the lifter 10. The rear supports 18, 20 may cooperate with either the wheels 50, 52 on the arcuate front supports 14, 16 or wheels 62, 64 on the straight front supports 58, 60 (FIG. 4, e.g.). In the illustrated embodiments, the rear supports 18, 20 are attached to the side members 12, 13 with, for example, hinges 36, 38. In a further embodiment, the hinges 36, 38 each include a ratchet mechanism (not shown) to facilitate raising the patient in the lifter 10, 100. Thus, even though a lift has not been completed, the lifter 10, 100 will not collapse downward but will hold the patient in at least a partially elevated position, thus enabling the individual doing the lift to effect a more advantageous position.

In further exemplary embodiments, the lifter 10, 100 includes first and second rear support clips 40, 42 to engage the rear supports 18, 20. As shown in exemplary fashion in FIG. 5, the rear supports 18, 20 may be secured out of the way by the rear support clips 40, 42 to facilitate use and to help prepare the lifter 10, 100 for storage or carrying. In a further embodiment, the rear supports 18, 20 are collapsible toward the front supports 14, 16; 58, 60.

Figure 5:
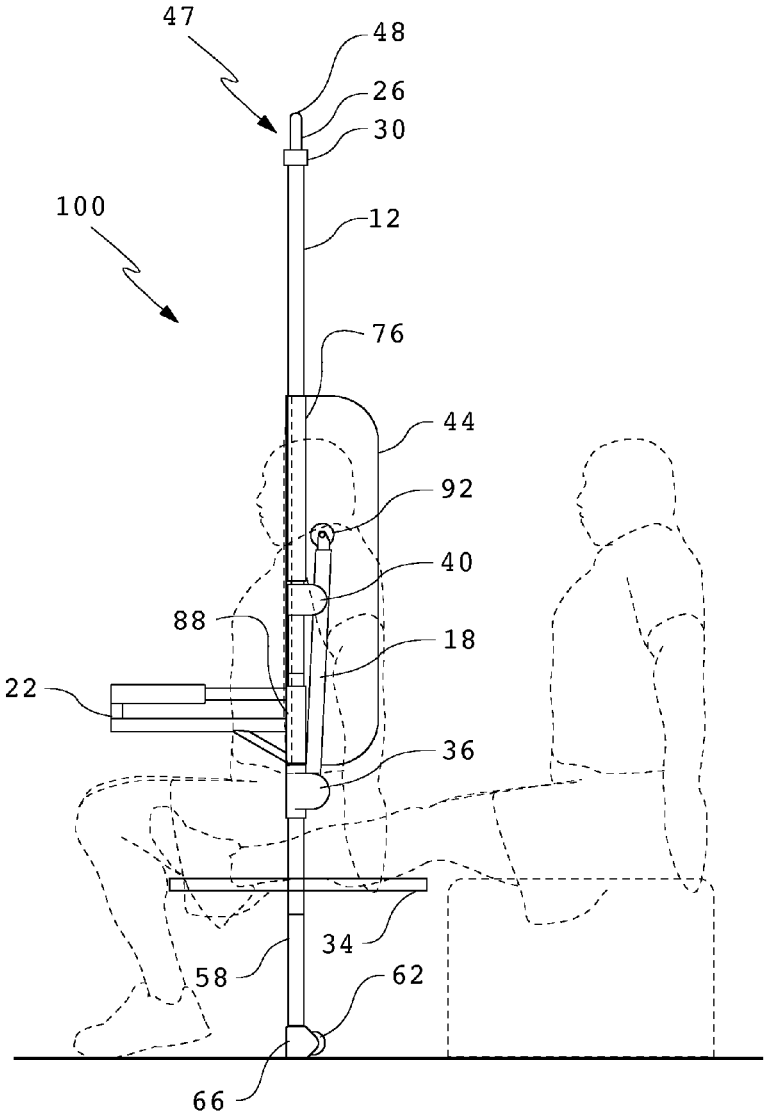
FIG. 5 is a side elevation view illustrating the patient lifter of FIG. 3 in a vertical position showing the patient transporting from the lifter to a bed or chair.
Figure 6:
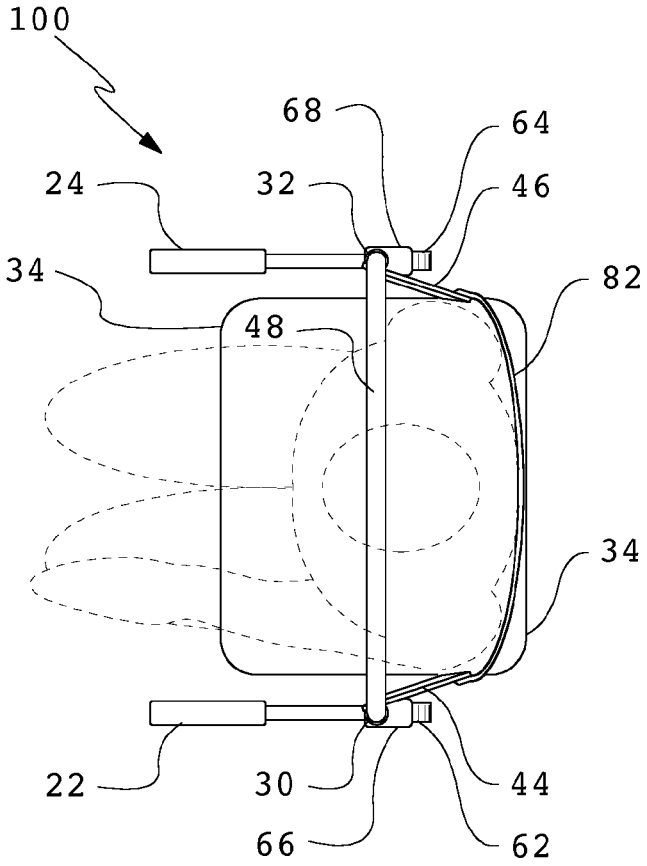
FIG. 6 is a top plan view illustrating a patient lifter.

In further exemplary embodiments, first and second side panels 44, 46 may be included to help provide support for the patient while in the lifter 10, 100. (Best seen in FIGS. 1, 5, and 6.) The side panels 44, 46 may include first and second side panel attachment clips 76, 78 to facilitate removable attachment to the first and second side members 12, 13. In an exemplary embodiment, each side panel 44, 46 is formed to include first and second C-shaped channels 76, 78, respectively, which clip onto the first and second side members 12, 13, respectively. In use, the side panels 44, 46 rotate about the side members 12, 13 to help provide support for the patient and still swing away to enable the patient to egress from the lifter 10, 100 (best seen in FIGS. 5 and 6). In a still further embodiment, as shown in FIG. 6, a sling 82 may be removably attached between the first and second side panels 44, 46. This embodiment helps provide further support for the patient yet may be removed to enable the patient to egress from the lifter 10, 100, as shown in FIGS. 2 and 5. Alternatively, the side panels 44, 46 may be omitted and the sling 82 attached directly to the side members 12, 13.

In a further exemplar embodiment, the lifter 10, 100 may include first and second armrests 22, 24 which may be attached to the first and second side members 12, 13, respectively. In a further exemplary embodiment, each of the first and second armrests 22, 24 are each formed to include first and second armrest sleeves 88, 90, respectively. Thus, the armrests 22, 24 may be rotatably installed on the side members 12, 13. And, as shown in FIG. 1, the armrests 22, 24 may be used as armrests to support the arms of the patient or swung around to the back of the lifter 10, 100 following first and second armrest swing arrows 70, 72 to help provide additional back support for the patient. The armrests 22, 24 may be further secured while in the back support position. (Shown by dashed lines in FIG. 1.) Then, when it is time for the patient to egress the lifter 10, 100, the armrests 22, 24 may be unsecured from the back and swung around toward the front.

The armrest sleeves 88, 90 may be sized to enable the armrests 22, 24 to be slid over the side members 12, 13 for ease of assembly. In addition, the armrest sleeves may include peripheral teeth and/or slots to cooperate with the side members 12, 13 to facilitate being locked into various positions.

In a further exemplary embodiment, each arcuate front support 14, 16 may include a friction pad 54, 56. As shown in FIG. 2, the patient may be raised to egress the lifter 10 by rotating the lifter 10 up on the friction pads 54, 46 to a substantially vertical position.

In a further exemplary embodiment, as shown in FIG. 1, a footrest 80 is operably attached to the first and second front supports 14, 16 by clips 86 (only one clip 86 shown in FIG. 1).

Figure 8:
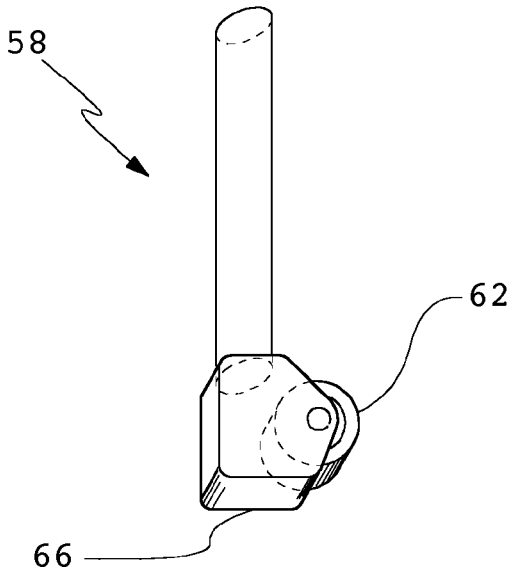
FIG. 8 is a perspective view illustrating a shoe of the patient lifter of FIG. 3.

In a further exemplary embodiment, shown in FIGS. 3-6, a lifter 100 includes first and second straight front supports 58, 60. The first and second straight supports 58, 60 may each include a wheel 62, 64 and each wheel 62, 64 may be at least partially covered by a shoe 66, 68 (best seen in FIG. 8). Thus, when transporting the patient, the lifter 100 may roll on the wheels 62, 64 and, when preparing to egress the patient and the lifter 100 is rotated to a vertical position (FIG. 5), the shoes 66, 68 rest on the floor to provide additional stability.

The lifter 100 having straight front supports 58, 60 also represents a second class lever system, albeit not having a variable fulcrum as with the lifter 10 having arcuate front supports 14, 16.

Figure 3:
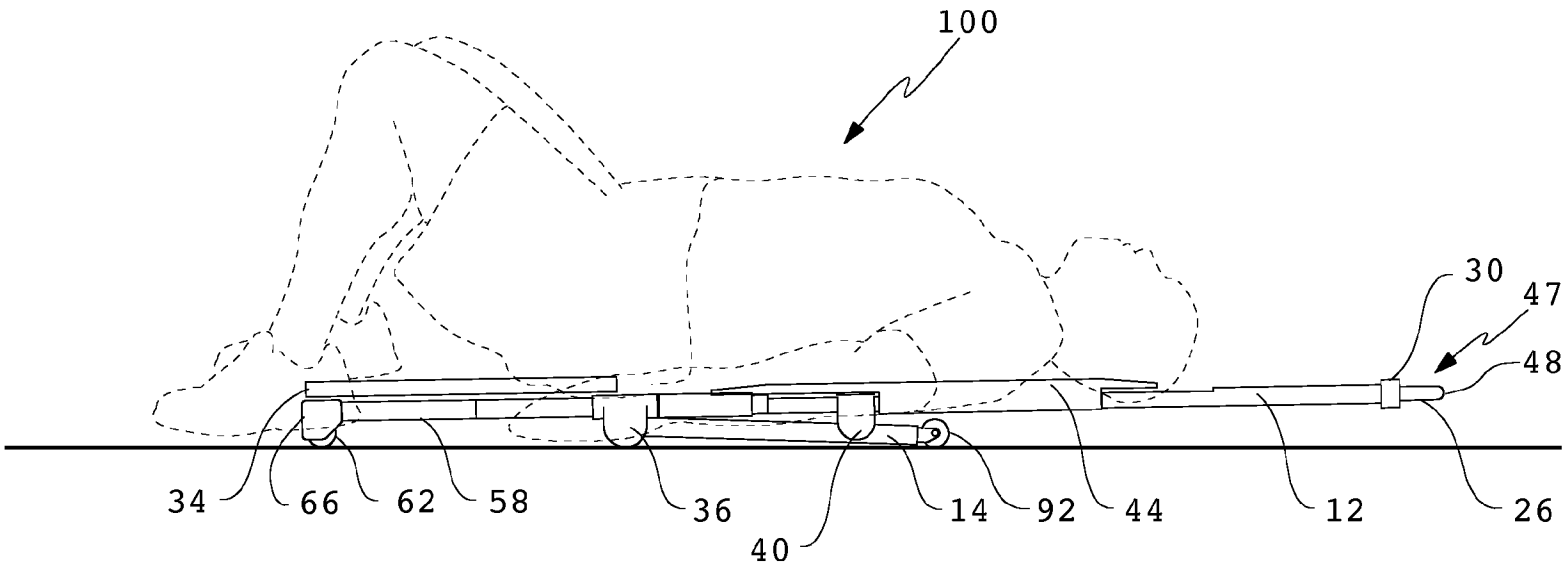
FIG. 3 is a side elevation view illustrating a patient lifter in a horizontal position prior to a patient lift.

In operation, the lifter 10, 100 is placed in a horizontal position (FIG. 3) by collapsing the rear support members 18, 20 to allow the lifter 10, 100 to lie flat. The patient is then moved onto the support 34 (FIG. 3). Turning now to FIG. 4, by lifting up on the handle 47, the patient begins to lift off the floor. Securing the armrests 22, 24 around the back of the patient and securing the side panels 44, 46 with the sling 82 provides additional support to the patient during the lift and during transport. As shown in FIG. 4, in the exemplary embodiment with rear support hinges 36, 38 formed with ratchet mechanisms, the lift may be interrupted, to, for example, allow the individual doing the lift to shift his grip, and the lifter 10, 100 still remain in position. (Shown also in FIG. 7.) As shown in FIGS. 2 and 5, when the patient is to egress, the lifter 10, 100 is in a substantially vertical position and the armrests 22, 24 swung away from the back and the sling 82 (FIG. 6) removed.

When using the lifter 10 shown in FIGS. 1 and 2, when the lift begins, the patient is near the fulcrum formed by the arcuate front supports 14, 16. In this position, the one doing the lift benefits from an increased mechanical advantage. As the lift progresses, the fulcrum point shifts along the arcuate front supports 14, 16 and the distance from the fulcrum point to the patient is increased. While this decreases the mechanical advantage, the one lifting is in a better position to apply greater lifting force. In addition, the vertical length of travel of the patient is greater for the same vertical length of travel of the handle 47.

This detailed description of the invention, in conjunction with the drawings, is intended principally as a description of embodiments of the invention, and is not intended to represent the only form in which the present invention may be constructed or utilized. The description sets forth the designs, functions, means, and methods of implementing the invention in connection with the illustrated embodiments. It is to be understood, however, that the same or equivalent functions and features may be accomplished by different embodiments that are also intended to be encompassed within the spirit and scope of the invention and that various modifications may be adopted without departing from the invention or scope of the following claims.

We claim:

1. A patient lifter apparatus, comprising:

first and second spaced side members, each side member having a first end and a second end;

a patient support, the patient support extending between the first and second side members proximate the first ends of the side members and adapted to at least partially rotate relative to an axis substantially perpendicular to the first and second side members, the axis located inboard of the front and back edges of the support, the patient support further adapted to substantially maintain at least a portion of the weight of the patient over the axis; and first and second spaced arcuate front supports, each front support extending from the first end of the first and second side members, respectively, an inside bend of each front support generally facing the patient support, wherein the arcuate supports provide a lifting mechanical advantage.

2. The apparatus of claim 1, further comprising a handle, the handle comprising:

first and second extensions, each extension in slideable relation with the second end of the first and second side members, respectively.

3. The apparatus of claim 2, the handle further comprising:

a handle cross member, the handle cross member extending between the first and second extensions.

4. The apparatus of claim 2, at least one extension comprising an end which inserts into the side member associated with the at least one extension, the end comprising a lip, an external diameter of the lip approximating an internal diameter of the associated side member.

5. The apparatus of claim 2, wherein the slideable relation is telescopic.

6. The apparatus of claim 5, further comprising first and second extension locks, the first and second extension locks operably connected to the second ends of the first and second side members, respectively, and operably connected to the first and second extensions, respectively.

7. The apparatus of claim 6, wherein the second end of at least one side member comprises external first-handed threads, and wherein the extension lock associated with the at least one side member comprises:

a finger lock, the finger lock having a passageway therethrough, the finger lock comprising:

a knob, the knob comprising internal first-handed threads, the knob internal first-handed threads adapted to cooperate with the at least one side member external threads to secure the finger lock to the side member; and a male taper, the male taper adjoining the knob and comprising:

external threads, the external threads opposite-handed the first-handed threads; and a plurality of flexible fingers; and a compression cap, the compression cap having a passageway therethrough, the compression cap comprising:

internal threads, the internal threads opposite-handed the first-handed threads, the compression cap internal threads adapted to cooperate with the male taper external threads; and a female taper, the female taper adapted to cooperate with the plurality of fingers to urge the fingers against the extension associated with the at least one side member.

8. The apparatus of claim 7, wherein:

the extension associated with the at least one side member further comprises an external stop, the external stop having an effective external diameter;

the finger lock further comprises an internal stop, the internal stop having an effective internal diameter less than the extension external stop effective external diameter.

9. The apparatus of claim 1, further comprising first and second armrests, the first and second armrests operably connected to the first and second side members, respectively.

10. The apparatus of claim 9, the first and second armrests further comprising first and second sleeves, respectively, attached thereto, the first and second sleeves rotatably attached to the first and second side members, respectively.

11. The apparatus of claim 1, the first and second front supports further comprising first and second front support wheels, respectively, the first and second front support wheels attached to an outside bend of the first and second front support, respectively.

12. The apparatus of claim 1, the first and second front supports further comprising first and second friction pads, respectively, attached thereto.

13. The apparatus of claim 1, further comprising a footrest, the footrest operably attached to the first and second front supports.

14. The apparatus of claim 1, further comprising first and second rear supports, the first and second rear supports operably attached to the first and second side members, respectively.

15. The apparatus of claim 14, wherein at least one of the first and second rear supports is ratchetably attached to its corresponding side member, whereby as the lifter is lifted from a horizontal surface, the at least one of the first and second rear supports becomes ratchetably secured relative to its corresponding side member.

16. The apparatus of claim 14, the first and second rear supports further comprising first and second rear support wheels, respectively.

17. The apparatus of claim 14, further comprising first and second rear support clips, the first and second rear support clips attached to the first and second side members, respectively, the first and second rear support clips adapted to releaseably secure the first and second rear supports, respectively, to the first and second side members, respectively.

18. The apparatus of claim 1, further comprising first and second side panels, the first and second side panels attached to the first and second side members, respectively.

19. The apparatus of claim 18, wherein the first and second side panels are rotatably attached to their respective side member.

20. The apparatus of claim 19, further comprising a sling extending between the first and second side panels.

21. A method of lifting a patient, comprising:

(a) placing the patient upon the patient support of claim 1;

(b) applying a first lifting force to a handle attached to second ends of the first and second side members, whereby the patient is at least partially lifted and whereby the first and second arcuate front supports enable a second class lever first mechanical advantage to the first lifting force over a weight of the patient; and (c) applying a second lifting force to the handle, whereby the patient is at least further lifted and whereby the arcuate front supports enable a second class lever second mechanical advantage to the second lifting force over the weight of the patient, the second lifting force greater than the first lifting force and the second mechanical advantage less than the first mechanical advantage.

22. The apparatus of claim 1, wherein the mechanical advantage varies from a first mechanical advantage to a second mechanical advantage.

* * * * *